United States Patent [19]

Lövgren

[11] 4,194,549

[45] Mar. 25, 1980

[54] UPWARDLY OPENABLE DOOR

[75] Inventor: Anders Lövgren, Skellefteå, Sweden

[73] Assignee: Alfred Lovgrens Byggnads Ab, Skelleftea, Sweden

[21] Appl. No.: 901,946

[22] Filed: May 1, 1978

Related U.S. Application Data

[63] Continuation of Ser. No. 741,840, Nov. 15, 1976, abandoned, which is a continuation of Ser. No. 345,373, Mar. 6, 1973, abandoned.

[30] Foreign Application Priority Data

Mar. 6, 1972 [SE] Sweden ..... 2807/72

[51] Int. Cl.[2] ..... A47H 5/00

[52] U.S. Cl. ..... 160/84 R

[58] Field of Search ..... 160/84 R, 32, 33, 130, 160/133, 117, 201, 207, 270, 271, 272, 274, 330, 338, 339, 341, 344, 346

[56] References Cited

U.S. PATENT DOCUMENTS

| | | | |
|---|---|---|---|
| 1,937,342 | 11/1933 | Higbie | 160/84 R |
| 2,834,411 | 5/1958 | Clements | 160/207 |
| 2,839,135 | 6/1958 | Anderson | 160/133 |
| 3,016,951 | 1/1962 | Greene | 160/346 X |
| 3,126,049 | 3/1964 | Hollands | 160/271 X |
| 3,321,003 | 5/1967 | Boerner | 160/330 X |
| 3,487,875 | 1/1970 | Shukat et al. | 160/84 R |
| 3,777,800 | 12/1973 | Susoev | 160/330 X |

FOREIGN PATENT DOCUMENTS

| | | | |
|---|---|---|---|
| 13740 | of 1887 | United Kingdom | 160/84 R |
| 965141 | 7/1964 | United Kingdom | 160/33 |

*Primary Examiner*—Philip C. Kannan
*Attorney, Agent, or Firm*—Pollock, Vande Sande & Priddy

[57] ABSTRACT

A collapsible door apparatus for industrial buildings and other installations where a high degree of utilization of the space inside of the door and large door openings are required, for example, for chamber driers. The door is characterized by a door member suspended at a section which is adapted to be attached to the upper limit surface of the door opening and comprises means for raising and lowering the door member by means of at least one wire rope attached to the lower part of the door member. The door member comprises at least one sheet of flexible material and a plurality of stiff cross-members spaced relative to each other and connected with the sheet of flexible material. The cross-members extend transversely of the door member and are guided at their ends in vertical guide bars attached to the vertical limit surfaces of the door openings. The wire rope extends through the cross-members and to the lowermost cross-member where it is attached thereto.

4 Claims, 6 Drawing Figures

UPWARDLY OPENABLE DOOR

This is a continuation of application Ser. No. 741,840 filed Nov. 15, 1976 and now abandoned. Application Ser. No. 741,840 is a continuation of application Ser. No. 345,373, filed Mar. 6, 1973, and now abandoned.

BACKGROUND OF THE INVENTION

This invention relates to a novel door for industrial buildings such as, for example, storehouses and the like, and particularly for such installations where a high degree of utilization of the space inside of the building is desired. A typical example of such an installation is a chamber drier for timber which comprises one or more drying chambers, in which the maximum storage space can be fully utilized only when the size of the door opening is equal to one side of the chamber. A door opening of a size so large, however, puts very high requirements on the door proper, particularly when the door is intended for use as a timber drier, because in that case the door must not allow a great amount of heat to pass through it and must maintain an overpressure in the drying chamber.

Chamber driers have heretofore used almost exclusively sliding doors, because they were found most suitable and permitted a door opening which was larger than that permitted, for example, by roll-front doors and top-suspended doors. A further obstacle to the use of this latter type of doors is the presence of ducts for hot air and the like which are installed within the drying chamber. Sliding doors, too, have shown certain disadvantages, particularly in chamber driers comprising more than one drying chamber, because in that case only one sliding door can be opened at a time. This problem, however, has been solved in such a manner that the door openings of the different drying chambers are so offset one relative to the other that the sliding door of one drying chamber is located in a plane different from that of the sliding door of the adjacent drying chamber. This solution, however, involves increased building costs and is not a satisfactory solution from a construction-technical point of view.

OBJECT OF THE INVENTION

The present invention has as its object, therefore, to produce a door, particularly for chamber driers, but also for other industrial buildings, where relatively large door openings are required, and which eliminates the disadvantages and problems of the prior art doors of chamber driers and similar installations. This object is achieved by the characterizing features of the invention as they are defined in the claims.

The invention will be described in greater detail hereinafter, with reference to the accompanying drawings, in which.

DETAILED DESCRIPTION OF THE PREFERRED EMBODIMENT

Figure 1:
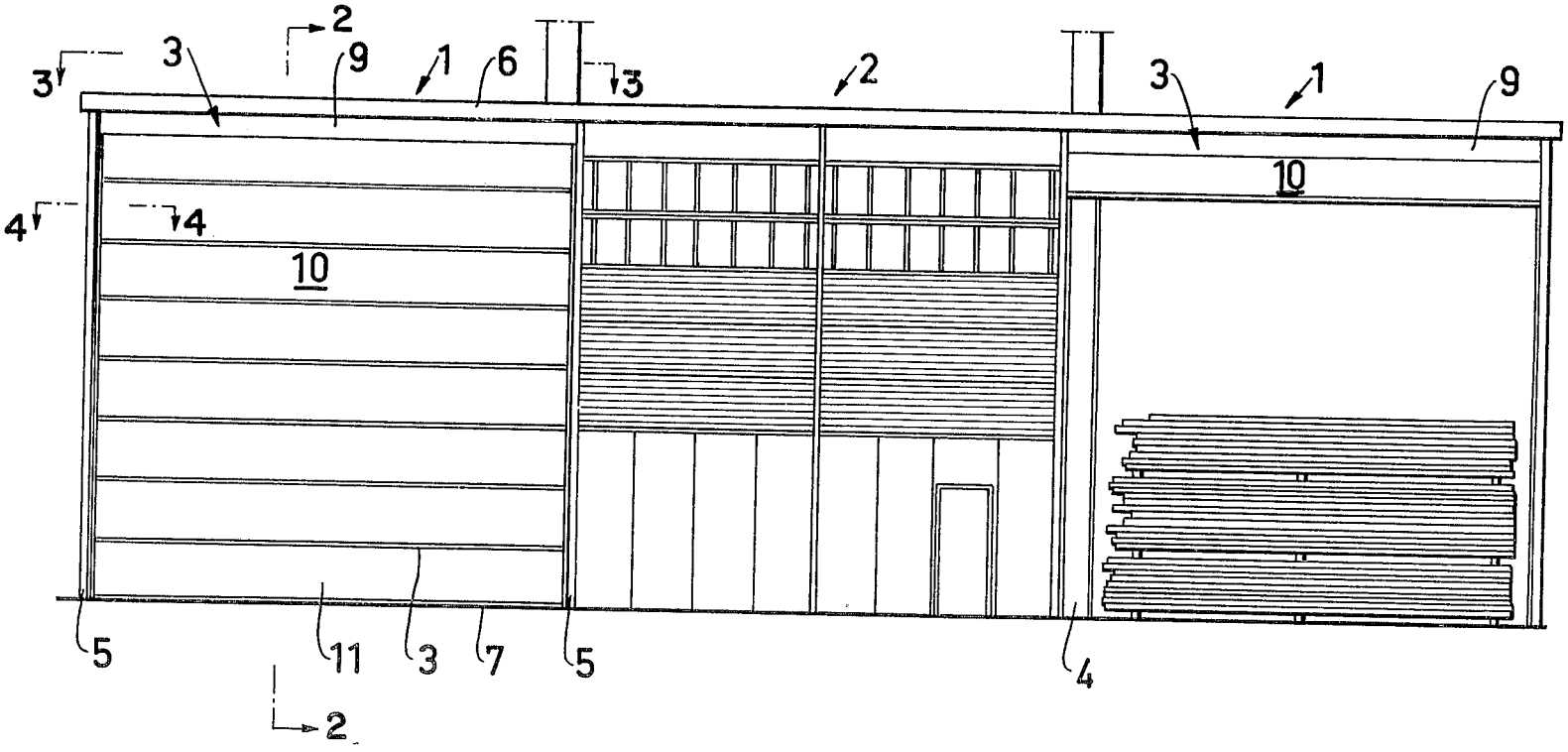
FIG. 1 shows a front view of a chamber drier with two drying chambers, each having a door according to the invention.

The chamber drier shown in FIG. 1 comprises two drying chambers 1, each situated on one side of an equipment room 2 and each provided with a door 3 according to the invention. The door of the left-hand chamber is shown in closed state, and the door of the right-hand chamber is shown in fully open state. 4 designates a vertical ventilation unit. Each door opening, which in the present case is as wide as the drying chamber and has a height corresponding substantially to the distance between the floor and the roof of the chamber, is defined by side posts 5, which are part of the carrying wall structures of the chamber, and by the roof 6 and the floor 7 of the chamber. The door is arranged at the lower side of the chamber roof 6 where it rests on the side posts 5, and the door is enclosed by guide bars 8 of U-shaped cross section mounted on the side posts 5.

The door apparatus according to the invention comprises two main parts, viz. a mechanism section 9 of box girder construction supported on the side posts 5, and a door member 10 fastened on the section 9. In the embodiment shown, the door member comprises two layers 11 of flame-proof flexible tight plastic fabric reinforced with nylon and also includes a plurality of substantially equally spaced cross-members 12 upon which the layers are secured by means of strips 13 fastened to the cross-members by screws, glueing, rivets or in any other appropriate way, which strips 13 are substantially as long as the layers 11 are wide. The cross-members 12, however, exceed in length the width of the layers 11 and carry at their ends guide wheels 14 of rubber, plastic or another suitable material. These wheels are arranged to roll against the guide bars 8 on both sides of the door and thereby guide the door member 10 so that it cannot move in a lateral direction. A further object of the cross-members 12, which extend in between the guide bar flanges opposing each other, is to take up the wind forces to which the door possibly may be exposed.

Figure 2:
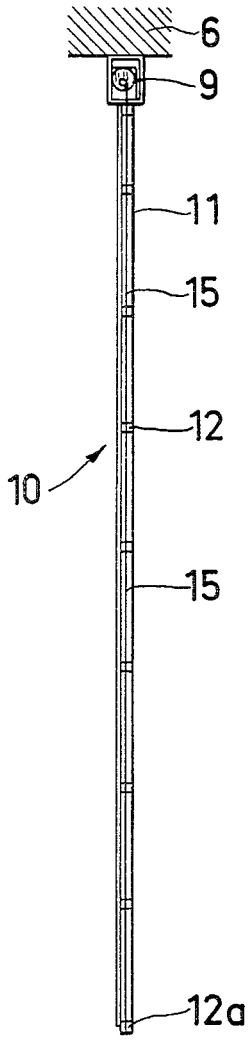
FIG. 2 shows a section along the line 2—2 in FIG. 1.
Figure 3:
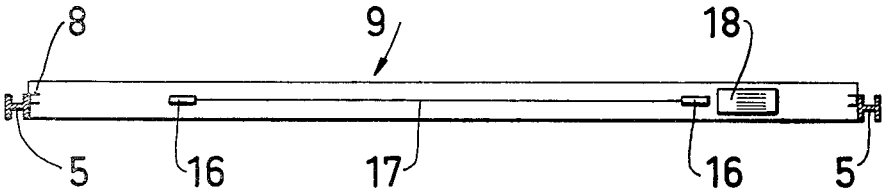
FIG. 3 shows in a schematic way a view along the line 3—3 in FIG. 1.

At the lower cross-member **12*a* of the door member (FIG. 2), two spaced wire ropes 15 are fastened which freely extend through the other cross-members 12 of the door member 10. Of the various cross-members 12 the uppermost one is fastened to the mechanism section 9, and the wire ropes 15 pass upwards through said cross-members 12 to said section 9. Within said section 9, each rope 15 is fastened on a respective drum 16 (FIG. 3). The drums are mounted on an axle 17 common to all drums, and such axle is supported in the section 9 and, via a gear (not shown in detail), is connected to a driving motor 18, preferably of electric type, which suitably can be switched on and off from a control console in the equipment room 2** of the chamber drier.

Figure 4:
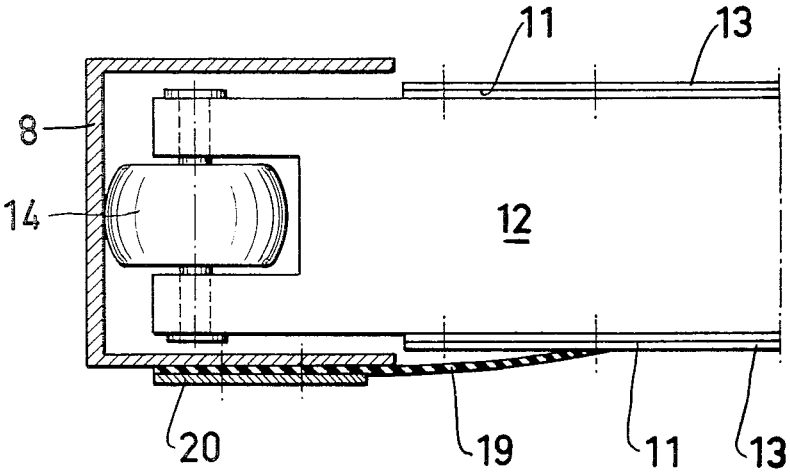
FIG. 4 shows a section along the line 4—4 in FIG. 1.

Each guide bar 8, as appears from FIG. 4, preferably on its side facing the chamber, is provided with a sealing strip 19 of rubber or like sealing material which is secured, or more precisely clamped, onto the guide bar 8 by means of a fastening strip 20 screwed onto the guide bar or secured thereon in another way. The sealing strip 19 extends inwards over the door member 10 along its entire height and presses against the door member for sealing between the door member 10 and the guide bar 8. Also, the lower cross-member **12*a*** of the door member may be provided on its lower side with a suitable means sealing against the floor, for example, with a rubber hose.

Figure 5:
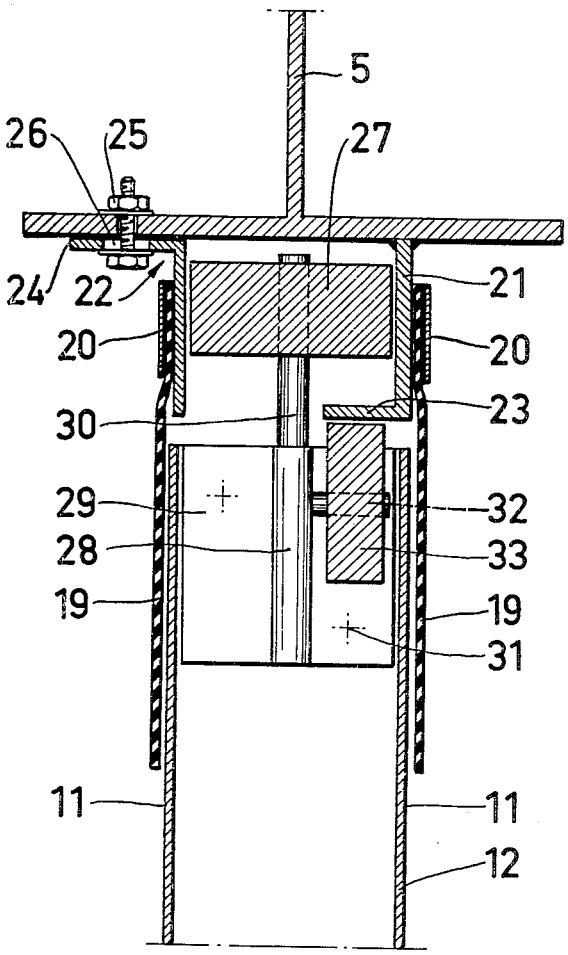
FIG. 5 shows substantially the same section as FIG. 4, but through an alternative embodiment of the door guide means.

In FIG. 5, an alternative embodiment of the device for guiding the door is shown, in which each U-shaped guide bar 8 has been replaced by two angle irons 21, 22, of which the iron 21 is firmly secured on the side post 5 so that the flange 23 of the iron is located in parallel with and spaced from the side post 5. The second angle iron 22 is connected with the side post 5 so that its flange 24 faces the post and is fastened thereon by bolts 25 which extend through oblong slots 26 in the flanges 24 of the angle irons 22 and thereby render it possible to adjust the distance between the webs of the angle irons 21, 22 which project from the post 5 as required.

Between said webs, and for coaction therewith, a guide wheel 27 is provided which is supported on an axle 30 mounted in an axle holder 28 in a mounting plate 29. The mounting plate 29 is inserted into the end of the cross-member 12 and there secured by screws as indicated at 31. In a recess in the mounting plate 29 an additional guide wheel 33 is mounted by means of an axle extending perpendicularly to the wheel axle 30. Said additional guide wheel projects with a portion of its circumference out from the cross-member and is so arranged that it abuts the flange 23 of the angle iron 21 and rolls thereagainst. Thus, by means of the guide wheels 27 and 33 at the two ends of at least some or all of the cross-members included in the door member, the door is positively guided in two directions perpendicular to each other and thereby is prevented from vibrating and chattering. In this alternative embodiment of the guide means of the door, sealing strips 19 are provided both on the inside and outside of the door.

Figure 6:
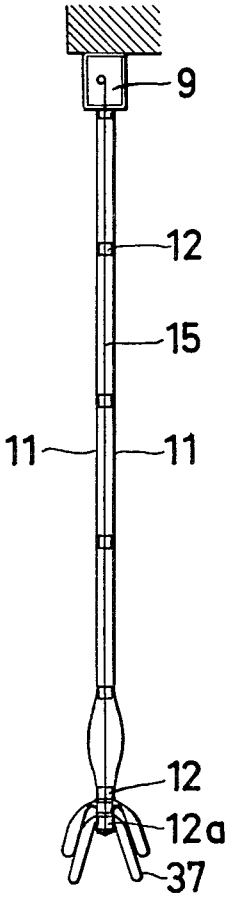
FIG. 6 shows the door according to the invention while it is being pulled up.

To open the door according to the invention, the motor 18 is started. Thereby the ropes 15 are wound on the drum 16 in question and the door member is lifted, in that the lower cross-member in the door member is brought into contact with the cross-member thereabove, and so on, until all cross-members abut each other. Due to the flexibility of the material in the door member, the flexible layers 11 between the cross-members 12 fold in the way shown in FIG. 6 and form loops 37 suspended on both sides of the cross-members. The space requirement of the door in open position, therefore, is small and the door occupies only a very small part of the door opening.

The present invention is not restricted to the door described above and shown in the drawings, but may be altered and modified in many different ways within the scope of the claims. It is possible, for example, that the door member shall comprise only one layer of flexible plastic 11 and that the distance between the cross-members of the door member, for example, is smaller or greater, the number of cross-members thereby being greater and, respectively, smaller.

What I claim is:

1. A collapsible door apparatus comprising:

a door member having a plurality of generally horizontal rigid spaced members, and at least one sheet of flexible material fastened to said spaced members;

a door frame including vertically disposed channel means for guiding the ends of said spaced members;

said channel means comprising first and second parallel spaced members arranged parallel to the plane of the door and a third member which is perpendicular to said first and second members;

first and second roller means at each end of said rigid members, one of said rollers being located between said first and second members and the other coacting with said third member;

and door operating means for selectively moving upwardly the bottom-most of said spaced members to thereby in turn move all said spaced members as said bottom-most member upon being raised abuts the next said member and so on until all said members have been raised to open the door;

said flexible material between each successive pair of said spaced members forming a loop of said material as the door is raised.

2. A door as defined in claim 1, characterized in that each channel means comprises two angle irons, of which one is movable in relation to its distance from the other.

3. A door as defined in claim 1, characterized in that for sealing between the door member and the door frame sealing strips are provided at the door frame at least one the inside of the door which strips extend inwardly over the door member along its entire height.

4. A door as defined in claim 1, characterized in that said at least one sheet of flexible material is secured on the cross-members by means of strips connected therewith.

* * * * *